US010147270B2

(12) United States Patent
Kim

(10) Patent No.: US 10,147,270 B2
(45) Date of Patent: Dec. 4, 2018

(54) JACKPOT GAME SERVER AND METHOD THEREOF TO COOPERATE EACH OTHER AMONG THE MEMBERS

(71) Applicant: DOUBLEUGAMES CO., LTD., Seoul (KR)

(72) Inventor: Ga Rham Kim, Seoul (KR)

(73) Assignee: DOUBLEUGAMES CO., LTD., Seoul (KR)

( * ) Notice: Subject to any disclaimer, the term of this patent is extended or adjusted under 35 U.S.C. 154(b) by 189 days.

(21) Appl. No.: 15/119,939

(22) PCT Filed: May 24, 2016

(86) PCT No.: PCT/KR2016/005466
§ 371 (c)(1),
(2) Date: Aug. 18, 2016

(87) PCT Pub. No.: WO2017/179757
PCT Pub. Date: Oct. 19, 2017

(65) Prior Publication Data

US 2018/0174400 A1 Jun. 21, 2018

(30) Foreign Application Priority Data

Apr. 11, 2016 (KR) ..... 10-2016-0044254

(51) Int. Cl.
*G07F 17/32* (2006.01)
*G06Q 50/00* (2012.01)
(Continued)

(52) U.S. Cl.
CPC ..... *G07F 17/3258* (2013.01); *G06Q 50/00* (2013.01); *G06Q 50/10* (2013.01);
(Continued)

(58) Field of Classification Search
None
See application file for complete search history.

(56) References Cited

U.S. PATENT DOCUMENTS

2012/0165088 A1 6/2012 Martinez-Ortega
2013/0122991 A1 5/2013 Malt
2016/0055710 A1 2/2016 Paradise et al.

FOREIGN PATENT DOCUMENTS

JP 3315954 B2 8/2002
JP 2009-511219 A 3/2009
(Continued)

OTHER PUBLICATIONS

Office Action dated Jul. 7, 2017, in Korean Patent Application No. 10-2016-0044254, 6 pages.
(Continued)

*Primary Examiner* — Ronald Laneau
(74) *Attorney, Agent, or Firm* — Nixon Peabody LLP; Jeffrey L. Costellia

(57) ABSTRACT

A jackpot game server that provides an online game includes: a machine manager that manages total jackpot money in each virtual machine by accumulating jackpots won by one or more users, who share each of the virtual machines; a dividend manager that, as a number of users who share one virtual machine increases, increases a dividend of game money acquirable among the total jackpot money accumulated in the one virtual machine by each of the at least one user who shares the one virtual machine; and a result sharer that distributes an online game play result, which is acquired by a certain user among the one or more users who share the one virtual machine, to other users who share the one virtual machine.

16 Claims, 14 Drawing Sheets

(51) Int. Cl.
*G06Q 50/10* (2012.01)
*G06Q 50/34* (2012.01)

(52) U.S. Cl.
CPC ..... *G06Q 50/34* (2013.01); *G07F 17/32* (2013.01); *G07F 17/3213* (2013.01); *G07F 17/3218* (2013.01); *G07F 17/3227* (2013.01); *G07F 17/3239* (2013.01); *G07F 17/3262* (2013.01); *G07F 17/3274* (2013.01); *G07F 17/3288* (2013.01)

(56) References Cited

FOREIGN PATENT DOCUMENTS

| | | | |
|---|---|---|---|
| JP | 2013-242798 | | 12/2013 |
| KR | 2002-0025102 | | 4/2002 |
| KR | 2005-0099072 | A | 10/2005 |
| KR | 10-1295615 | B1 | 8/2013 |
| KR | 2014-0132439 | A | 11/2014 |
| WO | WO 03/058521 | | 7/2003 |
| WO | WO 2013/175873 | | 11/2013 |

OTHER PUBLICATIONS

PCT Search Report, Korean Application No. PCT/KR2016/005466 dated May 24, 2016, 3 pages.
Korean Notice of Allowance (Application No. 10-2016-0044254), dated Jan. 26, 2018.

FIG. 7

| TOTAL JACKPOT MONEY OF MACHINE (FOR SERVER) | 100% | | | | | | | | | |
|---|---|---|---|---|---|---|---|---|---|---|
| INDIVIDUAL ALLOCATION (MAX) | 710b | | | | 20% | | | | | 712b |
| BETTING LEVEL | 1 | 2 | 3 | 4 | 5 | 6 | 7 | 8 | 9 | 10 |
| FIVE PERSONS | 2.0% | 4.0% | 6.0% | 8.0% | 10.0% | 12.0% | 14.0% | 16.0% | 18.0% | 20.0% |
| FOUR PERSONS | 1.6% | 3.2% | 4.8% | 6.4% | 8.0% | 9.6% | 11.2% | 12.8% | 14.4% | 16.0% |
| THREE PERSONS | 1.2% | 2.4% | 3.6% | 4.8% | 6.0% | 7.2% | 8.4% | 9.6% | 10.8% | 12.0% |
| TWO PERSONS | 0.8% | 1.6% | 2.4% | 3.2% | 4.0% | 4.8% | 5.6% | 6.4% | 7.2% | 8.0% |
| TWO PERSONS | 0.4% | 0.8% | 1.2% | 1.6% | 2.0% | 2.4% | 2.8% | 3.2% | 3.6% | 4.0% |
| | 710a | | | | | | | | | 712a |

JACKPOT GAME SERVER AND METHOD THEREOF TO COOPERATE EACH OTHER AMONG THE MEMBERS

CROSS-REFERENCE TO RELATED APPLICATIONS

This application is the U.S. national phase of International Patent Application No. PCT/KR2016/005466, filed May 24, 2016, which claims the benefit of Korean Patent Application No. 10-2016-0044254, filed Apr. 11, 2016, the contents of which are incorporated by reference herein in their entirety.

TECHNICAL FIELD

The present invention relates to a method of allowing one or more users to play a game together in a virtual machine and sharing a benefit provided by the virtual machine by sharing an online game play result.

BACKGROUND ART

Computer-based game players tend to participate in games as individuals. Also, the game players (gamers) tend to concentrate on game-related activities. However, these actions do not provide an opportunity to enable garners to enjoy merits of social interaction with other players. Furthermore, general online game systems do not provide a mechanism to encourage social interaction.

DETAILED DESCRIPTION OF THE INVENTION

Technical Problem

The present invention provides a method of allowing a plurality of users to carry out cooperation while playing the same game and performing game activities therebetween on a jackpot game server that can provide an online game by simultaneously connecting one virtual machine to one or more users via a network.

Technical Solution

According to a preferred embodiment of the present invention, a jackpot game server, which is capable of providing an online game by simultaneously connecting one virtual machine to one or more users via a network, includes: a machine manager that manages total jackpot money by accumulating jackpots in each virtual machine in real time, wherein the jackpots are accumulated whenever the one or more users, who share each of the virtual machines, play an online game; a client manager that displays game money, which is held by the one or more users, who share each of the virtual machines, with respect to each of the virtual machines; a dividend manager that, as the number of users who share one virtual machine increases, increases a dividend of game money acquirable among the total jackpot money accumulated in the one virtual machine by each of the one or more users who share the one virtual machine; and a result sharer that, when a certain user among the one or more users who share the one virtual machine wins a jackpot, distributes the won jackpot to other users who share the one virtual machine.

Advantageous Effects of the Invention

According to a preferred embodiment of the present invention, when more persons participate in the same machine, a jackpot game server increases jackpot money, as compared with a case where one person plays a game, thereby maintaining cooperation with other users.

In addition, even though a certain user among users who participate in the same machine wins a jackpot, jackpot winning money is equally distributed to all the users, thereby inducing the users to have sensitivity that benefits have been obtained thanks to other users who use the same machine.

Furthermore, in addition to the winning of the jackpot, users who share the same one virtual machine accumulatively save accumulated jackpot money together, and an online game play result such as big win or a bonus game is shared with users, thereby improving the pleasure of the game.

DESCRIPTION OF THE DRAWINGS

FIG. 7 illustrates an example in which a dividend proportion is different depending on the number of users, who use one virtual machine and a betting level, according to a preferred embodiment of the present invention;

BEST MODE

Figure 1:
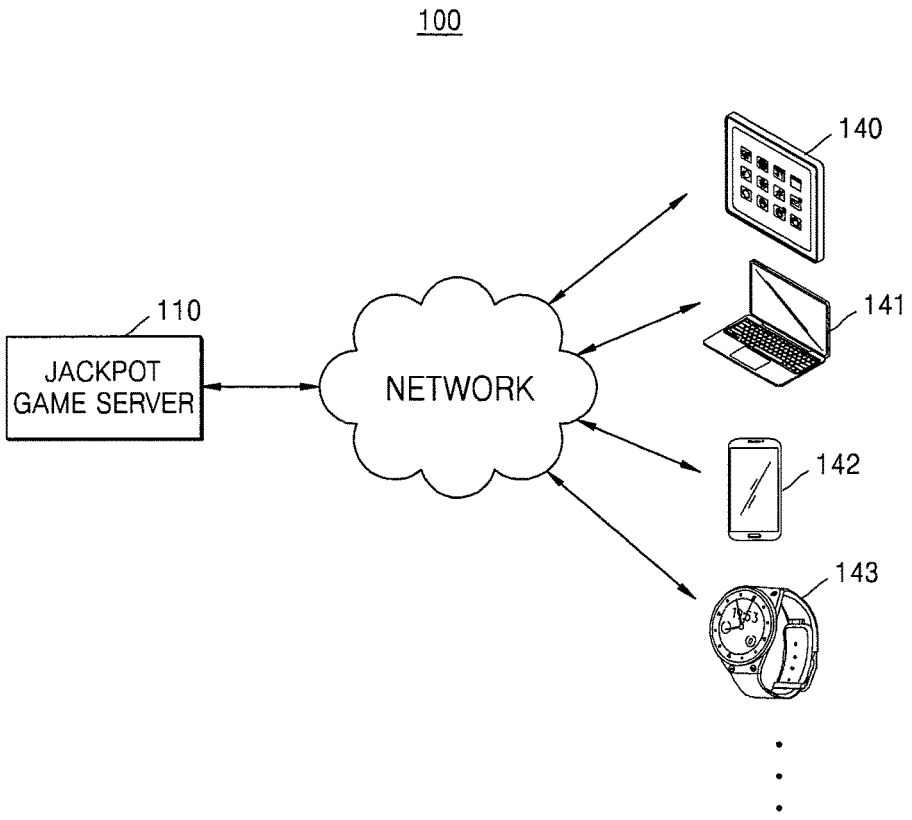
FIG. 1 is a diagram of a system in which users use a jackpot game provided by a jackpot game server, according to a preferred embodiment of the present invention.

According to a preferred embodiment of the present invention, a jackpot game server, which is capable of providing an online game by simultaneously connecting one virtual machine to one or more users via a network, includes: a machine manager that manages total jackpot money by accumulating jackpots in each virtual machine in real time, wherein the jackpots are accumulated whenever the one or more users, who share each of the virtual machines, play an online game; a client manager that displays game money, which is held by the one or more users, who share each of the virtual machines, with respect to each of the virtual machines; a dividend manager that, as the number of users who share one virtual machine increases, increases a dividend of game money acquirable among the total jackpot money accumulated in the one virtual machine by each of the one or more users who share the one virtual machine; and a result sharer that, when a certain user among the one or more users who share the one virtual machine wins a jackpot, distributes the won jackpot to other users who share the one virtual machine.

Preferably, when a certain user among the one or more users who share the one virtual machine wins a jackpot, the result sharer equally distributes the won jackpot to other users who share the one virtual machine.

Preferably, the dividend manager allocates the dividend of the game money among total jackpot money available with respect to each of the virtual machines according to the number of users who share the one virtual machine and a betting ratio of a certain user who shares the one virtual machine.

According to another preferred embodiment of the present invention, a jackpot game server, which provides an online game by simultaneously connecting one virtual machine to one or more users via a network, includes: a machine manager that manages total jackpot money in each virtual machine by accumulating jackpots won by one or more users, who share each of the virtual machines; a dividend manager that, as the number of users who share one virtual machine increases, increases a dividend of game money acquirable among the total jackpot money accumulated in the one virtual machine by each of the at least one user who shares the one virtual machine; and a result sharer that distributes an online game play result, which is acquired by a certain user among the one or more users who share the one virtual machine, to other users who share the one virtual machine.

According to another preferred embodiment of the present invention, a method of allowing one or more users to carry out cooperation, which is performed by a jackpot game server capable of providing an online game by simultaneously connecting one virtual machine to the one or more users via a network, includes: managing total jackpot money in each virtual machine by accumulating jackpots won by one or more users, who share each of the virtual machines; as the number of users who share one virtual machine increases, increasing a dividend of game money acquirable among the total jackpot money accumulated in the one virtual machine by each of the at least one user who shares the one virtual machine; distributing, by a result sharer, an online game play result, which is acquired by a certain user among the one or more users who share the one virtual machine, to other users who share the one virtual machine, wherein the other users increase a jackpot winning probability by using the distributed online game play result; and when a certain user among the one or more users who share the one virtual machine wins a jackpot, equally distributing, by the result sharer, the won jackpot to other users who share the one virtual machine.

Mode of the Invention

Figure 2:
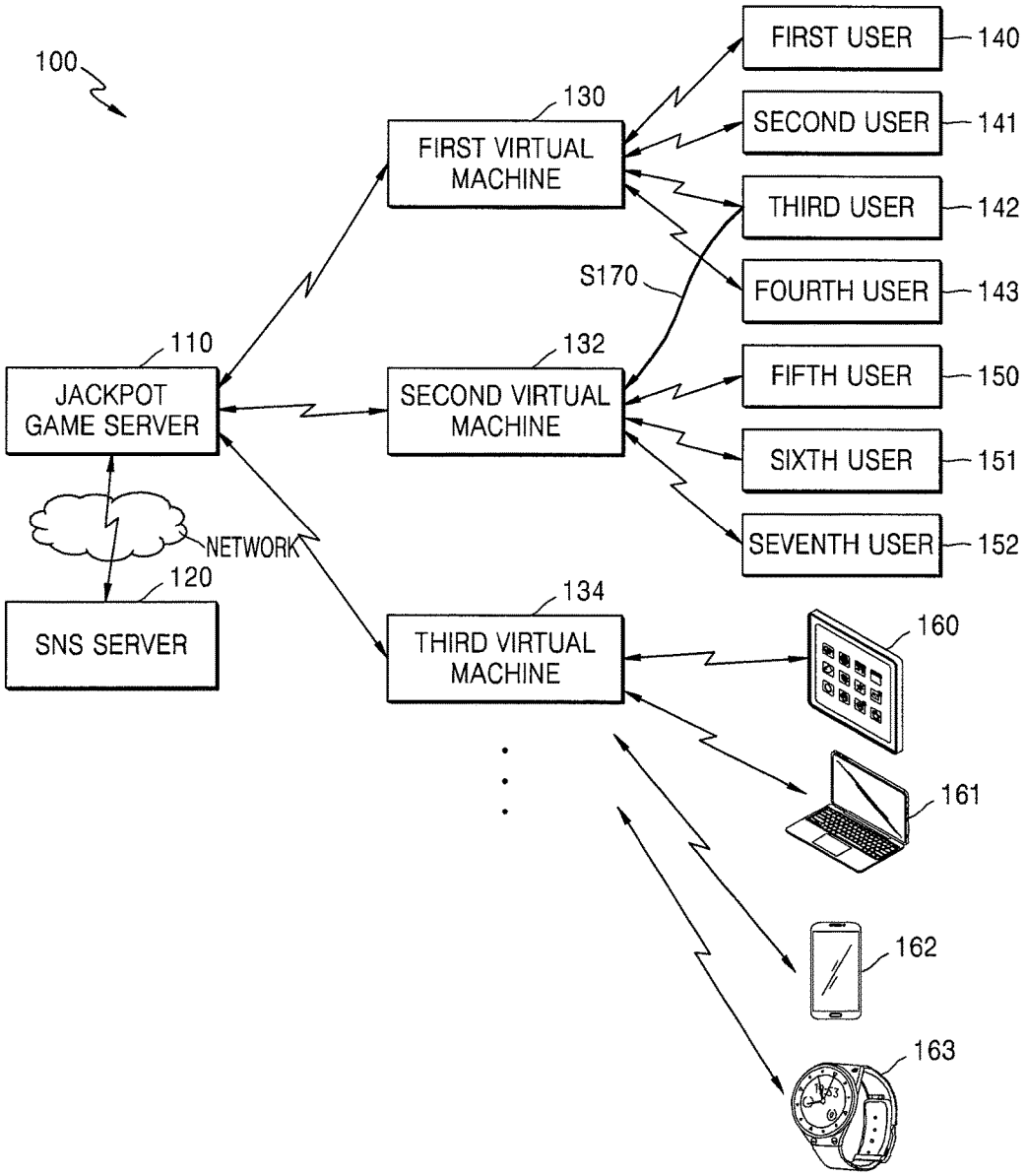
FIG. 2 is a diagram of a system in which a jackpot game server provides a jackpot game to one or more virtual machines and one or more users use the jackpot game on each virtual machine, according to another preferred embodiment of the present invention.

FIG. 1 is a diagram of a system in which users use a jackpot game provided by a jackpot game server, according to a preferred embodiment of the present invention. FIG. 2 is a diagram of a system in which a jackpot game server provides a jackpot game to one or more virtual machines and one or more users use the jackpot game on each virtual machine, according to another preferred embodiment of the present invention.

A system 100 for providing a jackpot game will be described below with reference to FIGS. 1 and 2.

According to a preferred embodiment of the present invention, the system 100 for providing the jackpot game includes a jackpot game server 110, and terminals 140, 141, 142, and 143 that are used by one or more users who access the jackpot game server 110 via a network. The terminals 140, 141, 142, and 143 may include computers, notebook computers, smart phones, smart watches, tablets, handheld devices, smart TVs, and the like.

According to a preferred embodiment of the present invention, the jackpot game server 110 may also interwork with a social network service (SNS) server 120. In addition, users 140 to 143, 150 to 152, and 160 to 163, who are connected to the jackpot game server 110 via the network, may interwork with the SNS server 120. The users 140 to 143, 150 to 152, and 160 to 163 may invite friends or other users to play the jackpot game together through interworking with the SNS server 120 (see FIG. 13).

The jackpot game server 110 may manage a plurality of virtual machines. For example, referring to FIG. 2, the jackpot game server 110 may manage a first virtual machine 130, a second virtual machine 132, and a third virtual machine 134. Each of the virtual machines 130, 132, and 134 corresponds to a machine of an object concept.

Referring to FIG. 2, the first virtual machine 130 is jointly used by four users 140, 141, 142, and 143, the second virtual machines 132 is jointly used by three users 150, 151, and 152, and the third virtual machine 134 is jointly used by four users 160, 161, 162, and 163.

According to a preferred embodiment of the present invention, a plurality of users may simultaneously access the system 100 for providing the jackpot game and play the jackpot game or the like. According to a preferred embodiment of the present invention, while playing the jackpot game, the plurality of game users may be induced to voluntarily assist other users in playing a game.

The users who use the first virtual machine 130, the second virtual machine 132, and the third virtual machine 134 may save jackpots in a same virtual machine and share a big win or an online game play result acquired in a bonus game or the like with all or some other users who use the same virtual machine.

Also, the first virtual machine 130, the second virtual machine 132, and the third virtual machine 134 may provide the same jackpot game or different jackpot games and may impose restrictions to conditions of users with respect to each virtual machine.

Figure 3:
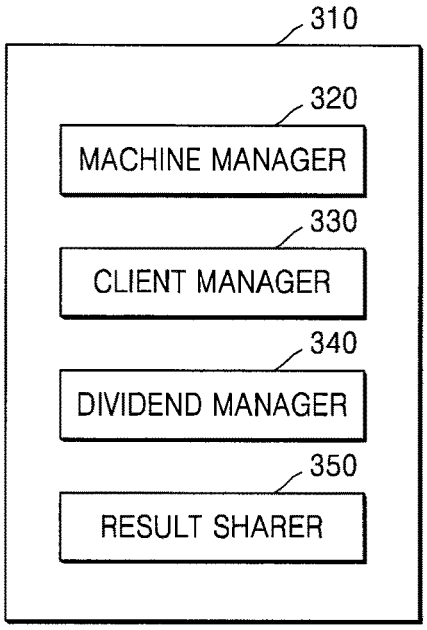
FIG. 3 is an internal configuration diagram of a jackpot game server, according to a preferred embodiment of the present invention.

FIG. 3 is an internal configuration diagram of a jackpot game server, according to a preferred embodiment of the present invention.

A jackpot game server 310 includes a machine manager 320, a dividend manager 340, and a result sharer 350. In addition, the jackpot game server 310 may further include a client manager 330.

The machine manager 320 manages total jackpot money accumulated in each virtual machine by accumulating jackpots in real time, wherein the jackpots are accumulated whenever one or more users, who share each virtual machine with respect to each virtual machine, play the online game.

Figure 4:
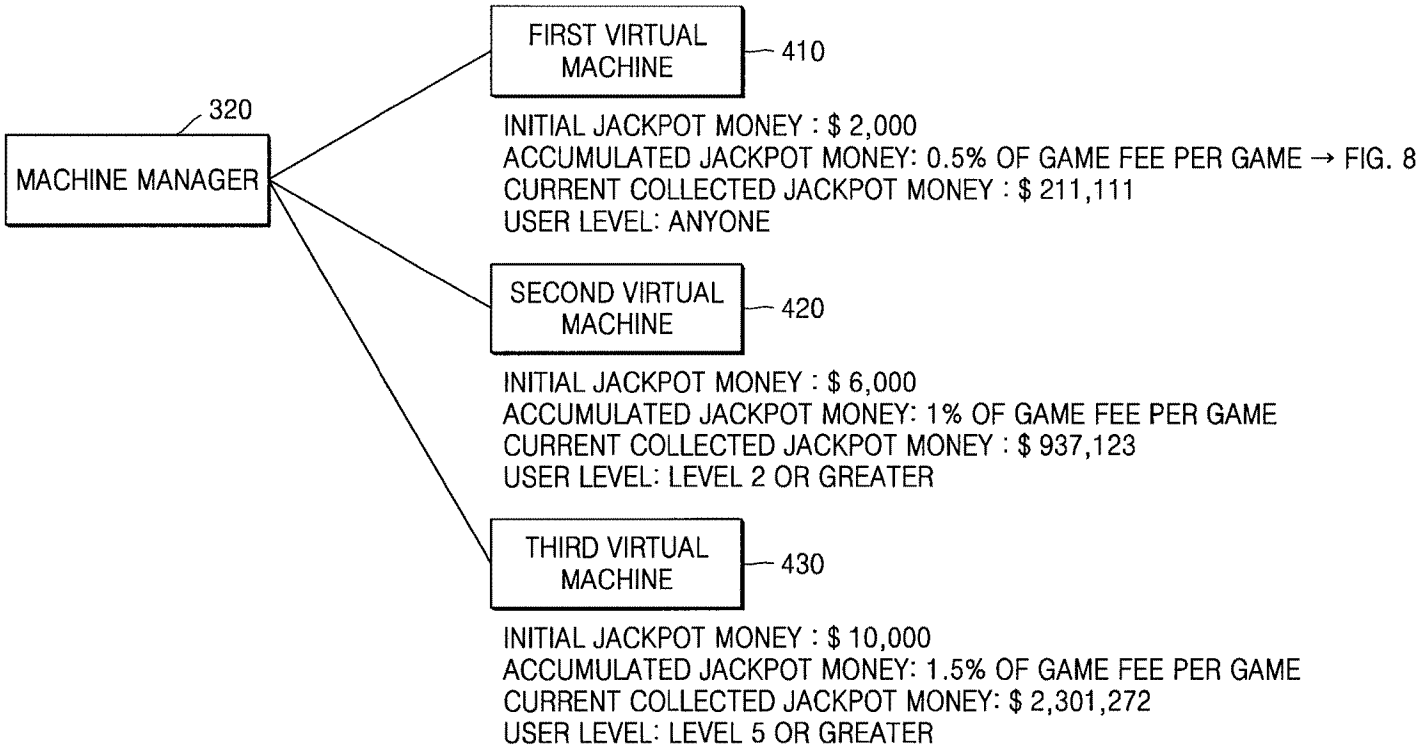
FIG. 4 illustrates a configuration of a machine manager of a jackpot game server, according to a preferred embodiment of the present invention.
Figure 8:
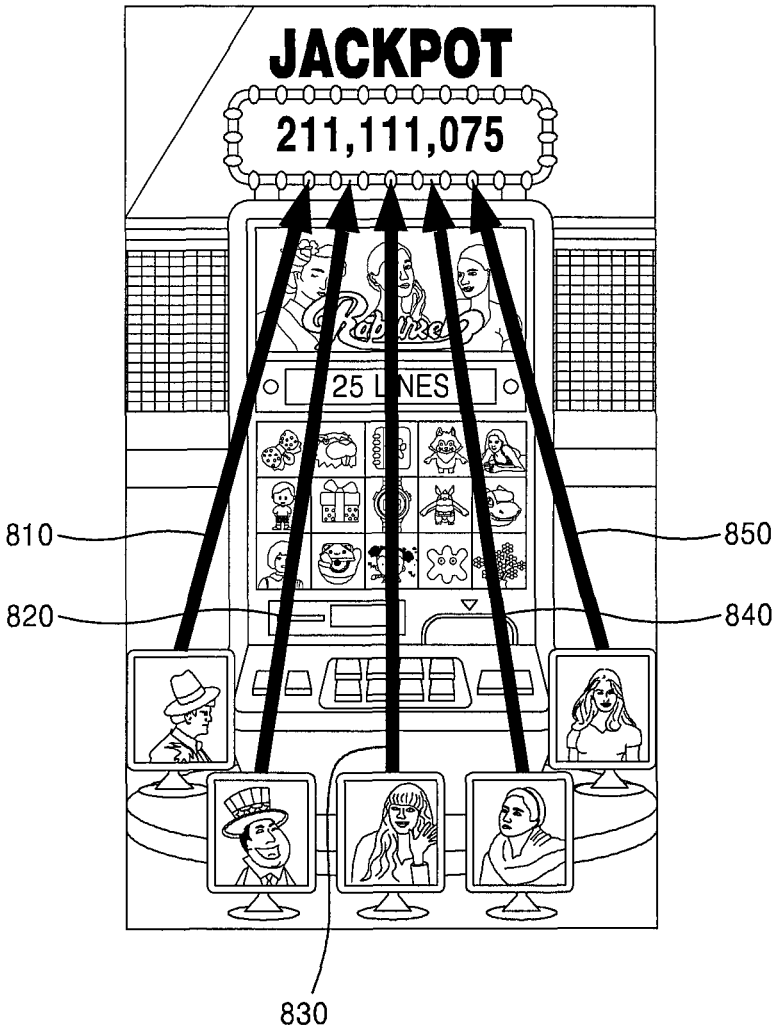
FIG. 8 illustrates an example in which users, who use one virtual machine, accumulate a jackpot in the one virtual machine in real time, according to a preferred embodiment of the present invention.

Referring to FIG. 4, the machine manager 320 may set initial jackpot money of the first virtual machine 410 to $2,000, collect 0.5% of a game fee as a commission whenever users, who use the first virtual machine 410, play a game, and accumulate the collected game fee in accumulated jackpot money of the first virtual machine 410. For example, referring to FIG. 8, in a case where five users use the first virtual machine 410, 0.5% of a game fee is collected as a commission whenever each of the five users plays a game, and the game fee is accumulated in accumulated jackpot money (810, 820, 830, 840, and 850).

The machine manager 320 may differently set initial jackpot money to each virtual machine. Also, a proportion accumulated as the accumulated jackpot money may be differently set to each virtual machine.

For example, in the case of the first virtual machine 410, the machine manager 320 may perform setting so that anyone is allowed to participate in and use a game, regardless of restrictions on a user level, and 0.5% of a game fee is accumulated as accumulated jackpot money.

Similarly, in the case of the second virtual machine 420, the machine manager 320 may perform setting so that only users having a user level of level 2 or greater are allowed to participate in a game and 1% of a game fee is accumulated as accumulated jackpot money. The user level will be described with reference to FIG. 12.

Similarly, in the case of the third virtual machine 430, the machine manager 320 may perform setting so that only users having a user level of level 5 or greater are allowed to participate in a game and 1.5% of a game fee is accumulated as accumulated jackpot money.

The machine manager 320 may perform setting so that, as the accumulated jackpot money increases, a user, who uses a corresponding virtual machine, wins a larger jackpot amount.

Figure 5:
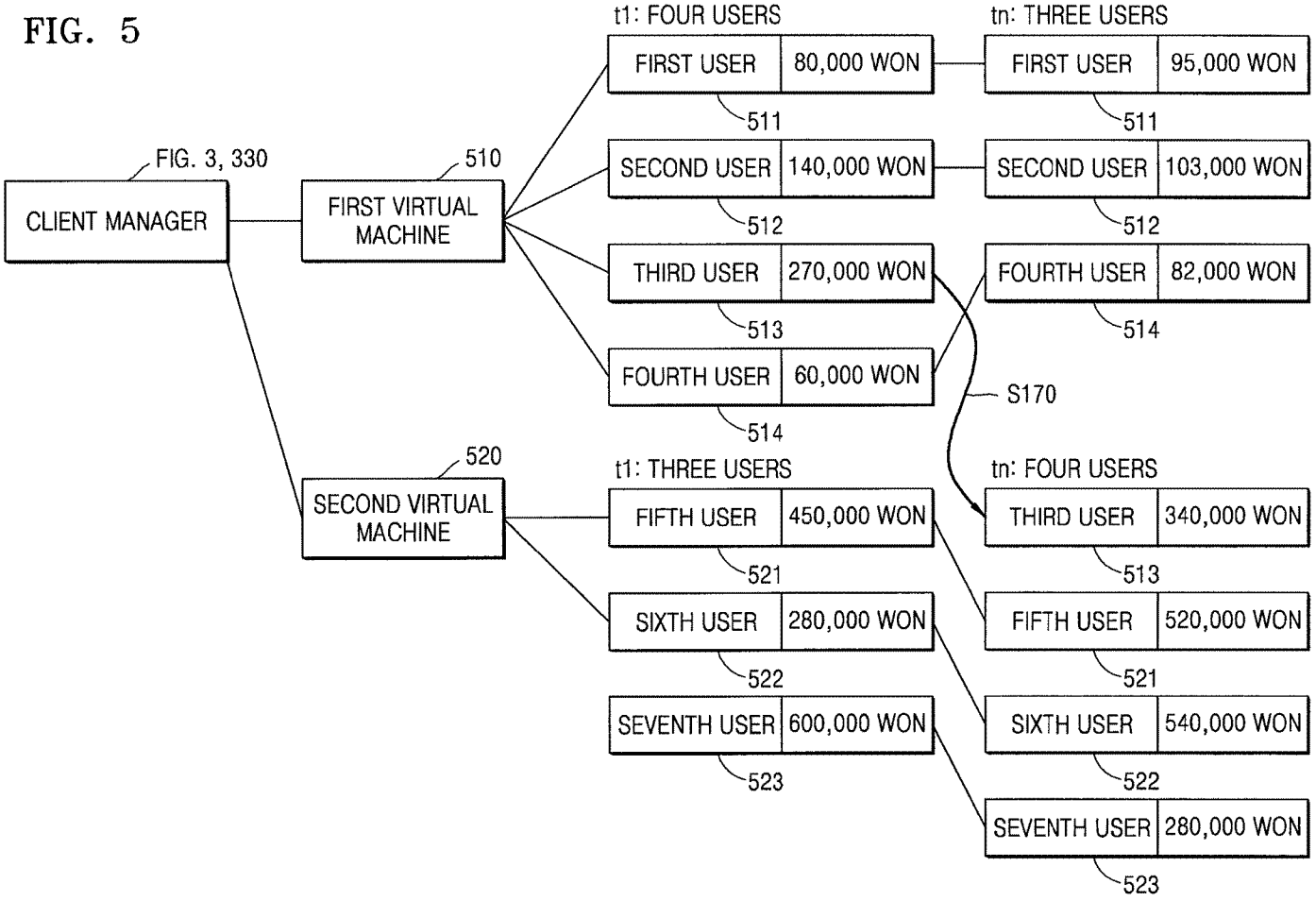
FIG. 5 illustrates a configuration of a client manager of a jackpot game server, according to a preferred embodiment of the present invention.

FIG. 5 illustrates the configuration of the client manager 330 of the jackpot game server, according to a preferred embodiment of the present invention.

The client manager 330 displays game money held by each of one or more users, who share each virtual machine with respect to each virtual machine. In a case where four users use the first virtual machine 510 and jointly play a game at time t1, the client manager 330 may display, on a screen, a first user 511, a second user 512, a third user 513, and a fourth user 514, who share the first virtual machine 510 with one another. Also, the game money held by each of the first, second, third, and fourth users 511, 512, 513, and 514 may be displayed in real time.

In this case, the first, second, third, and fourth users 511, 512, 513, and 514, who access the first virtual machine 510 by using their own terminals, may receive from the client manager 330 and confirm information about access conditions of other users, game conditions of other users, and game money held by other users through their own terminals.

The client manager 330 may provide online game playing information, such as winning or non-winning of a jackpot, winning or non-winning of a big win, and playing or non-playing of a bonus game.

Figure 6:
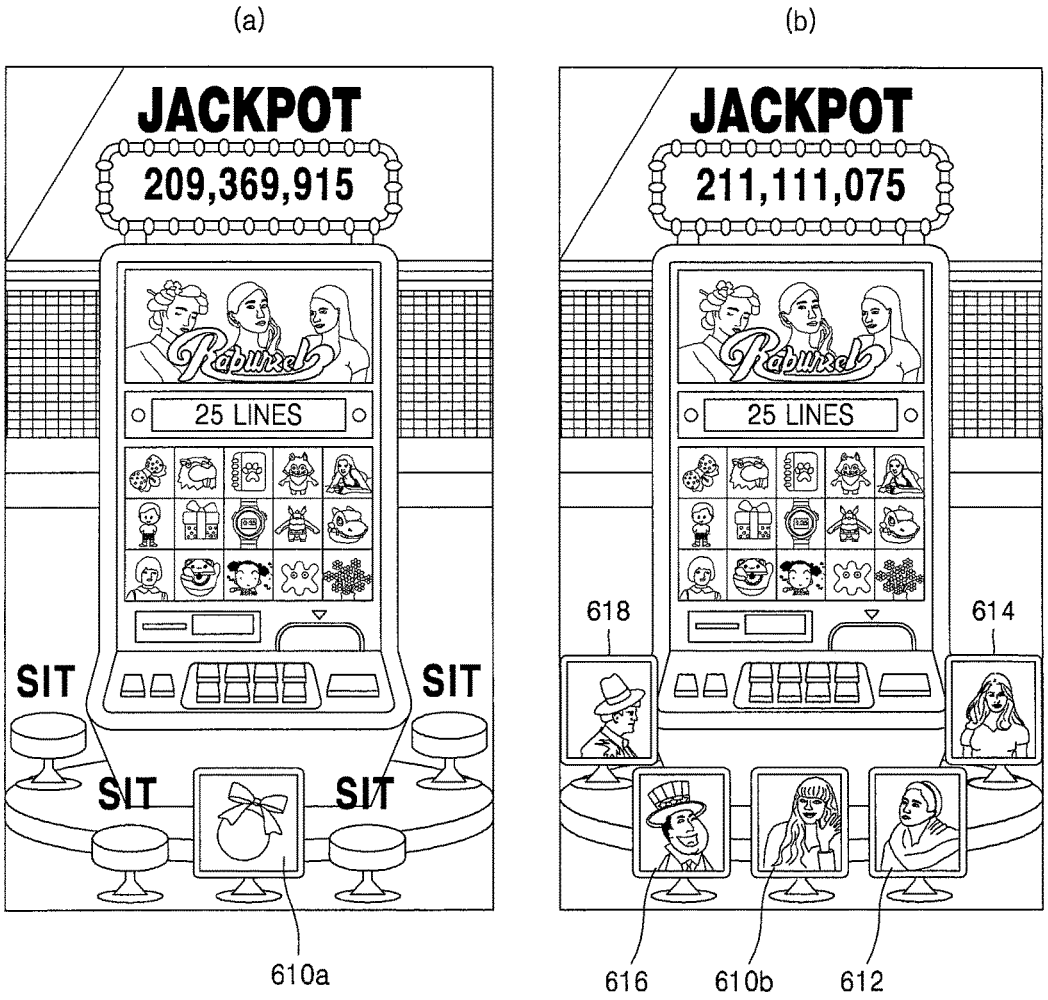
FIGS. 6A and 6B respectively illustrate a case where one user is present in one virtual machine and a case where five users are present in one virtual machine, according to a preferred embodiment of the present invention.

Referring to FIG. 5, game money holding conditions of the users who use the first virtual machine 510 in the case of time t1 are as follows:

First user 511: 80,000 won
Second user 512: 140,000 won
Third user 513: 270,000 won
Fourth user 514: 60,000 won Game money holding conditions of the users who use the second virtual machine 520 in the case of time t1 are as follows:

Fifth user 521: 450,000 won
Sixth user 522: 280,000 won
Seventh user 523: 600,000 won After that, in a case where the third user 513, who has played the game on the first virtual machine, leaves the game of the first virtual machine and moves to the second virtual machine at time t2, information provided by the client manager 330 is as follows:

Game money holding conditions of the users who use the first virtual machine at time tn are as follows:

First user 511: 95,000 won
Second user 512: 103,000 won
Fourth user 514: 82,000 won Game money holding conditions of the users who use the second virtual machine at time tn are as follows:

Third user 513: 340,000 won
Fifth user 521: 520,000 won
Sixth user 522: 540,000 won
Seventh user 523: 280,000 won FIGS. 6A and 6B respectively illustrate a case where one user 610*a* uses one virtual machine and a case where five users 610*b*, 612, 614, 616, and 618 use one virtual machine, according to a preferred embodiment of the present invention.

FIG. 7 illustrates an example in which the dividend manager of the jackpot game server sets a dividend depending on the number of users and a betting level, according to a preferred embodiment of the present invention.

According to a preferred embodiment of the present invention, the dividend manager (340 in FIG. 3) performs setting so that a dividend increases as the number of users, who use one virtual machine, increases. Thus, there is an effect that users, who use the jackpot game provided by one virtual machine, encourage other users to participate in the jackpot game.

Referring to FIG. 7, when on user (610*a* in FIG. 6) uses the virtual machine and the betting level of 1 is selected, the winnable dividend is merely 0.4% 710*a*.

On the other hand, when the users (610*b*, 612, 614, 616, and 618 in FIG. 6) use one virtual machine, a certain user 610*a* among the five users selects the betting level of 1, the winnable dividend increases to 2% 710*b*. If a certain user

610*b* selects the betting level of 10, the winnable dividend is 20% 712*b* that corresponds to the maximum dividend allocated to one user.

Although FIG. 7 illustrates an example of a case where the number of users, who use one virtual machine, is limited to five, the number of users may be variously modified and the betting level and the dividend may also be variously modified.

However, according to a preferred embodiment of the present invention, the dividend manager (340 in FIG. 3) performs setting so that the dividend that can be won by a user increases as the number of users increases.

Figure 9:
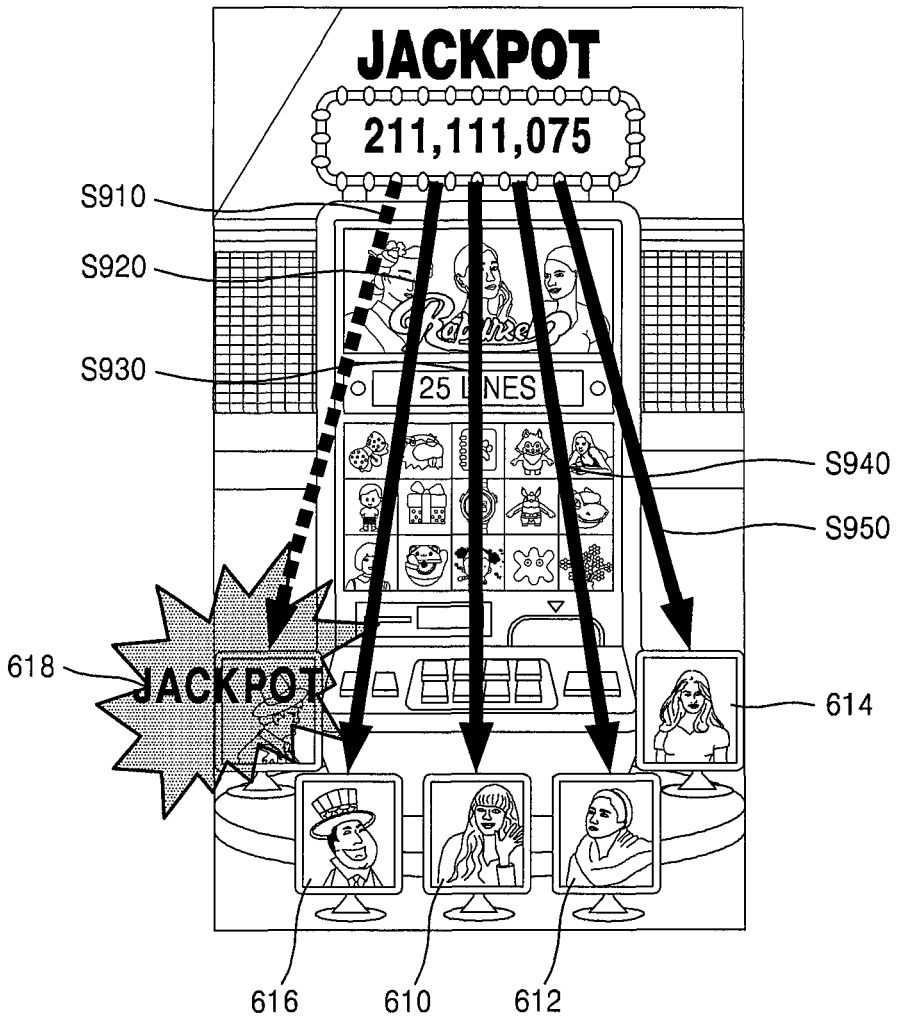
FIG. 9 illustrates an example in which, when a certain user among a plurality of users, who use one virtual machine, wins a jackpot, the won jackpot is equally distributed to other users who use the one virtual machine, according to a preferred embodiment of the present invention.

FIG. 9 illustrates an example of the result sharer of the jackpot game server, according to a preferred embodiment of the present invention.

When a certain user among one or more users who share one virtual machine wins a jackpot, the result sharer (350 in FIG. 3) equally distributes the won jackpot to other users who share the one virtual machine.

According to a preferred embodiment of the present invention, various users accumulatively save accumulated jackpot money in one virtual machine, and the accumulated jackpot money is equally distributed to and shared with the other users even when a certain user among the users who share one virtual machine acquires the saved accumulated jackpot money. Therefore, the users may encourage other users to play the game better and have fun cooperating with other users.

Referring to FIG. 9, when a certain user 618 among five users 610, 612, 614, 616, and 618, who use one virtual machine, wins a jackpot (S910), the total accumulated jackpot money (211,111,075 won) is equally distributed to the five users (S910, S920, S930, S940, and S950).

When the certain user 618 wins the jackpot (S910), the game money of each of the five users increases by the equally distributed money, for example, 211,111,075/5=42,222,215 won.

Figure 10:
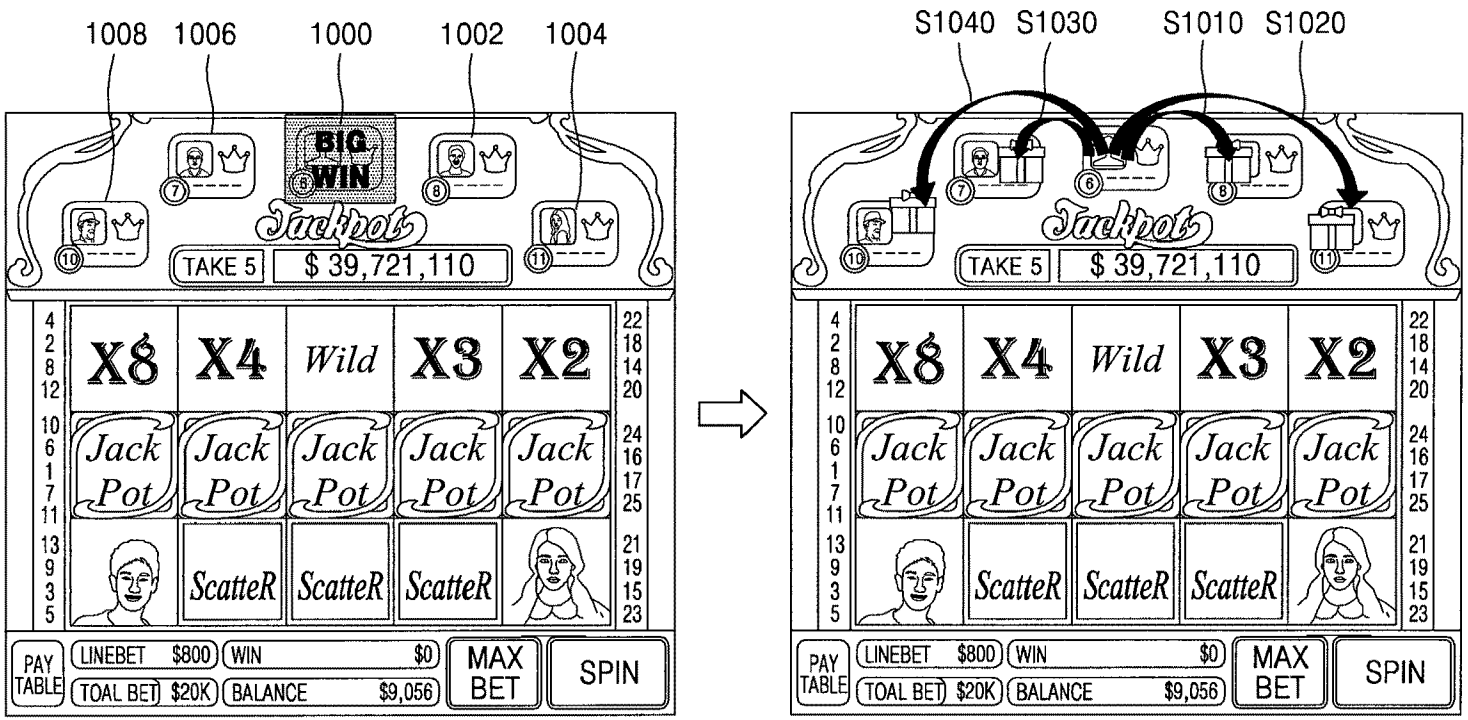
FIG. 10 illustrates an example in which, when a certain user among a plurality of users, who use one virtual machine, acquires an online game play result called "big win", the online game play result is distributed to other users, according to a preferred embodiment of the present invention.

FIG. 10 illustrates an example in which, when a certain user among a plurality of users, who use one virtual machine, acquires an online game play result called "big win", the online game play result is distributed to other users, according to a preferred embodiment of the present invention.

When a certain user 1000 among five users 1000, 1002, 1004, 1006, and 1008, who use one virtual machine, acquires an online game play result called "big win", the certain user 1000 may select all or some of the other four users 1002, 1004, 1006, and 1008 and distribute the acquired online game play result to the selected users.

The certain user 1000 may check game progress conditions, the held game money, and the like of the other four users 1002, 1004, 1006, and 1008 by using information provided by the client manager (330 in FIG. 3) and may distribute the online game play result to users needing the same. In this case, the online game play result may be distributed as a gift, like a ticket distribution, as illustrated in FIG. 11.

In this case, a user level of a user who distributes the accumulated jackpot money or a user who distributes the online game play result may be increased. As the user level of the user is increased, an authority to use a jackpot game provided by other virtual machines in which an amount of accumulated jackpot money is larger is given to the corresponding user.

The plurality of users, who use one virtual machine, may distribute the online game play result to one another or may share the online game play result with one another. In this case, the online game play result may be distributed to other users by gifting in a ticket form.

Figure 11:
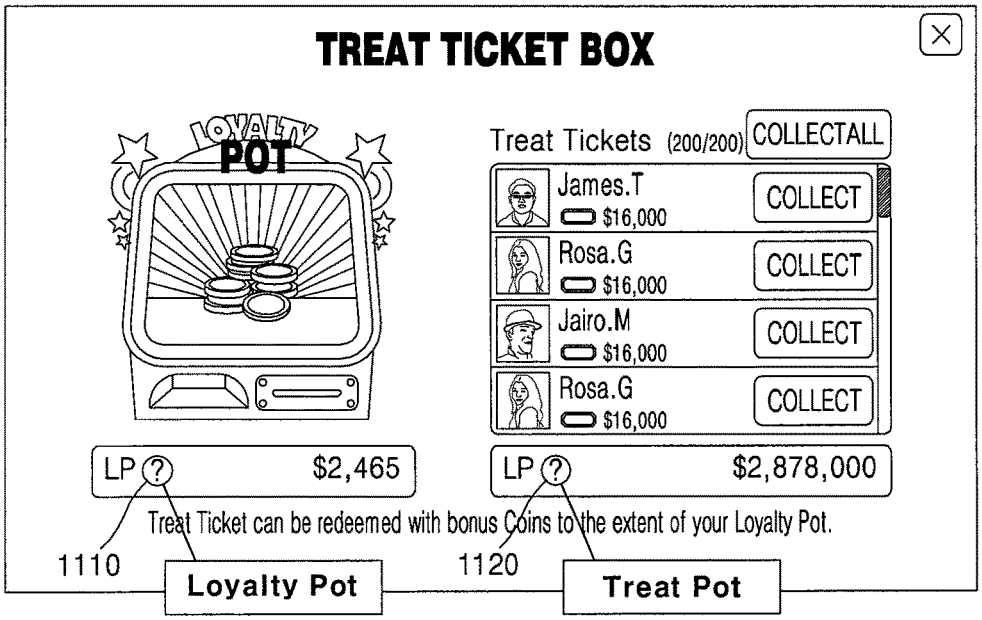
FIG. 11 illustrates an example in which a certain user distributes an online game play result in a ticket form as in the example of FIG. 10, and the distributed online game play result of the ticket form is changed into game money, according to a predetermined embodiment of the present invention.

The users may change the online game play result given and received in the ticket form into game money, as illustrated in FIG. 11. However, the change into game money is performed only within a system called "loyalty pot" 1110 in the example of FIG. 11. The loyalty pot 1110 is a system for preventing a user from free-riding on a game and is a system designed so that a portion (for example, 0.5%) of money used in a game by a user who shares one virtual machine is saved and the user is allowed to change a ticket received by another user into game money only when the number of times playing the game is a preset value or more.

When a condition required by the loyalty pot 1110 is satisfied, the user can change the received tickets into game money in a treat pot 1120.

FIG. 11 illustrates an example in which a certain user distributes an online game play result in a ticket form as in the example of FIG. 10, and the distributed online game play result of the ticket form is changed into game money, according to a predetermined embodiment of the present invention.

Figure 12:
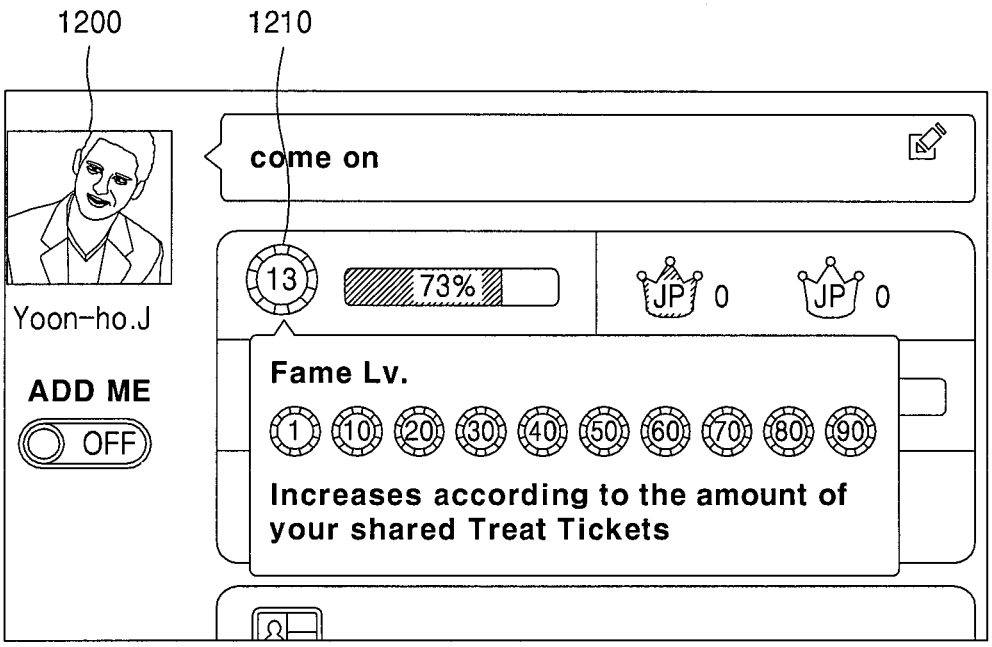
FIG. 12 illustrates a user level of a certain user who uses one virtual machine, according to an embodiment of the present invention.

FIG. 12 illustrates a user level of a certain user who uses one virtual machine, according to an embodiment of the present invention. The user level is further increased when a user further gifts other users an online game play result acquired while using one virtual machine.

Figure 13:
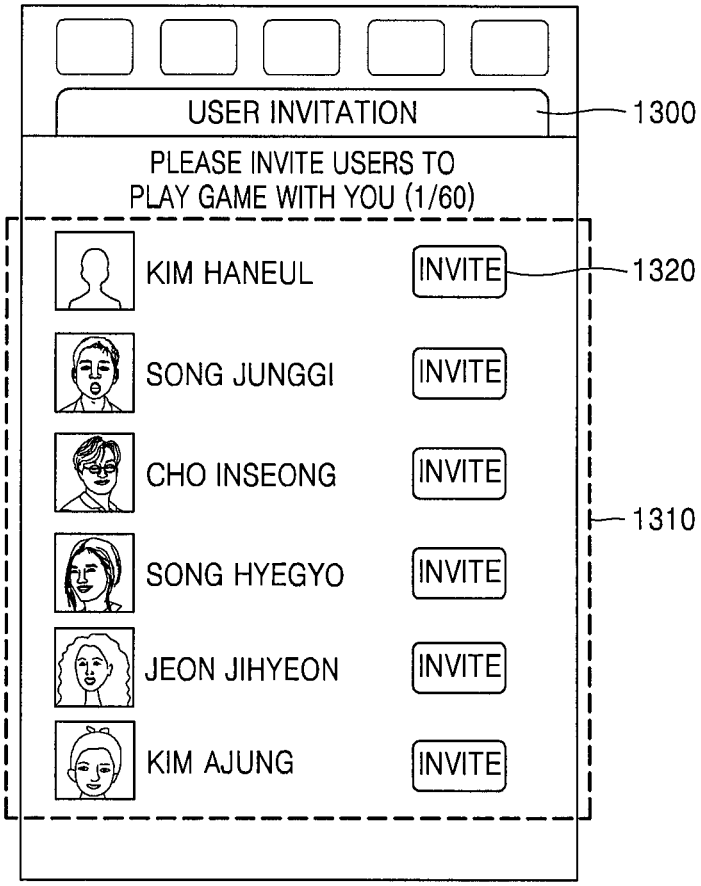
FIG. 13 illustrates an example of an interface through which a certain user who uses one virtual machine invites a user who is to use a game provided by the same virtual machine from a social network site, a phone book, an address book, or the like, according to a preferred embodiment of the present invention.

FIG. 13 illustrates an example of an interface through which a certain user who uses one virtual machine invites a user who is to use a game provided by the same virtual machine from a social network site, a phone book, an address book, or the like by using a social network service or a friend search service, according to a preferred embodiment of the present invention.

Figure 14:
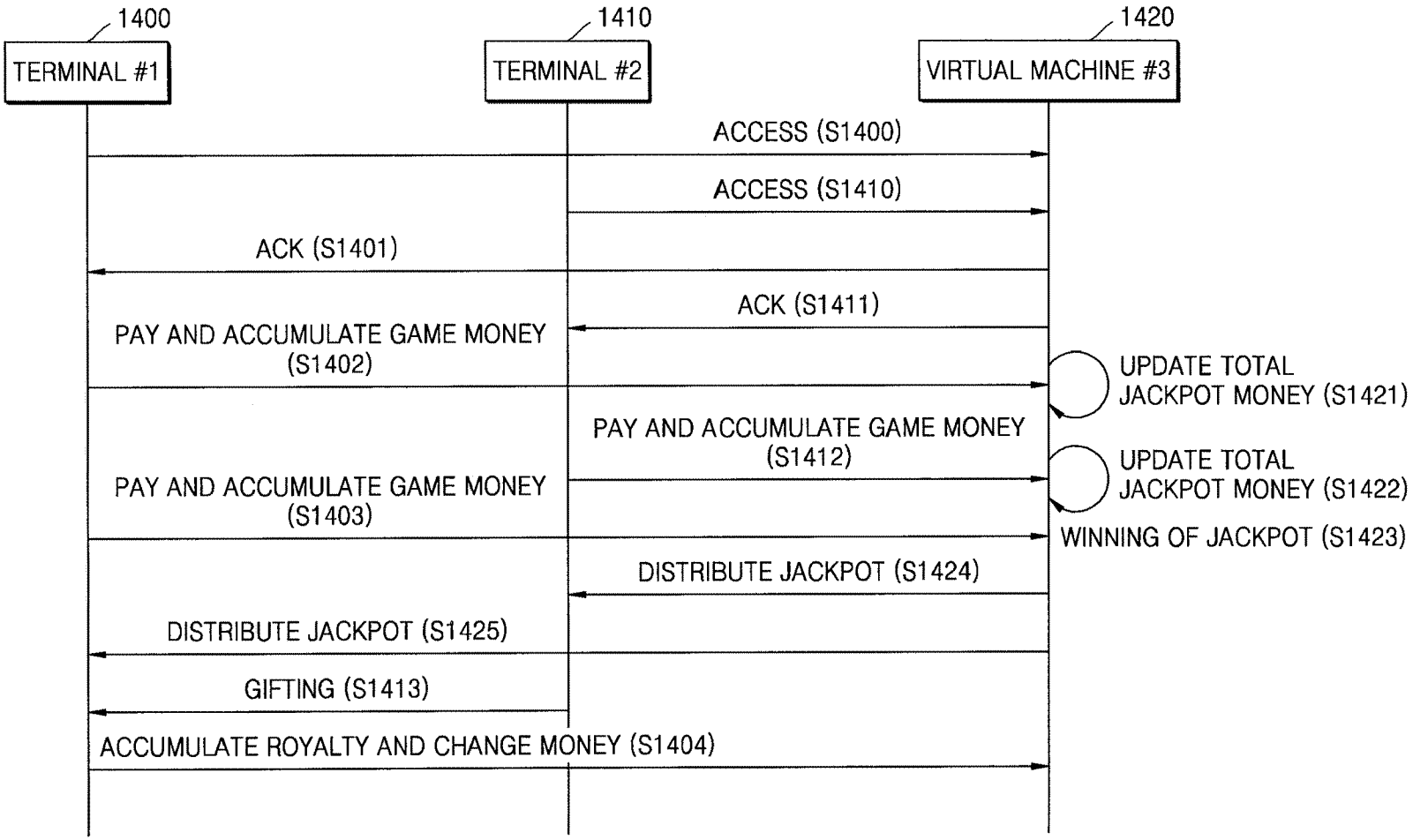
FIG. 14 illustrates an example of payment and accumulation of game money, jackpot distribution, gifting, accumulation of royalty occurring when a first terminal and a second terminal access one virtual machine and plays a game, and money change, wherein the one virtual machine provides a jackpot game supported by a jackpot game server, according to a preferred embodiment of the present invention.

FIG. 14 illustrates an example of payment and accumulation of game money, jackpot distribution, gifting, accumulation of royalty occurring when a first terminal and a second terminal access one virtual machine and play a game, and money change, wherein the one virtual machine provides a jackpot game supported by a jackpot game server, according to a preferred embodiment of the present invention.

It is assumed that both of a user of a first terminal 1400 and a user of a second terminal 1410 use a jackpot game provided by a first virtual machine 1420. In this case, the user of the first terminal 1400 and the user of the second terminal 1410 access the first virtual machine 1420 (S1400, S1410, S1401, and S1411) and accumulatively save accumulated jackpot money in real time (S1402, S1421, S1412, and S1422).

For example, when the user of the first terminal 1400 participates in the game once, game money is paid and a portion of the paid game money is accumulatively saved as the accumulated jackpot money of the first virtual machine 1420 (S1402 and S1421). Similarly, the accumulated jackpot money is saved in real time whenever the user of the first terminal 1400 participates in the game. Also, when the user of the second terminal 1410 participates in the game, the accumulated jackpot money is accumulatively saved as the accumulated jackpot money of the first virtual machine 1420, as in the case of the user of the first terminal 1400 (S1412 and S1422). The accumulated jackpot money saved by the user of the first terminal 1400 and the accumulated jackpot money saved by the user of the second terminal 1410 may be accumulatively saved as the accumulated jackpot money of the first virtual machine 1420 at the same time.

When one of the user of the first terminal 1400 and the user of the second terminal 1410 wins the jackpot while the accumulated jackpot money is accumulatively saved through the above process (S1423), the accumulatively saved accumulated jackpot money is equally distributed to the user of the first terminal 1400 and the user of the second terminal 1410 (S1424 and S1425).

Also, the user of the first terminal 1400 or the user of the second terminal 1410 may perform gifting to the other in the process of playing the game (S1413). The user level of the user who gifts the online game play result to another user is increased.

When the user saves a preset portion of money while playing the game a preset number of times or more, the user may change the gifting received from another user into game money and use the game money (S1404).

The present invention can be embodied as computer-readable code on a computer-readable recording medium. The computer-readable recording medium is any data storage device that can store data which can be thereafter read by a computer system. Examples of the computer-readable recording medium may include read-only memory (ROM), random access memory (RAM), compact disk-ROMs (CD-ROMs), magnetic tapes, floppy disks, and optical data storage devices. Also, the computer-readable recording medium can be distributed over network-coupled computer systems so that the computer-readable code is stored and executed in a distributed fashion.

While the preferred embodiments have been particularly shown and described. Although specific terms are used herein, these terms are only for the purpose of describing particular embodiments and are not intended to limit the meaning and the scope of the inventive concept. Thus, it will be understood by those of ordinary skill in the art that various modification and equivalents can be made therein. Therefore, the scope of the invention is defined by the appended claims.

The invention claimed is:

1. A jackpot game server configured to provide an online game by simultaneously connecting at least one virtual machine to one or more users via a network, the jackpot game server comprising:

a machine manager configured to accumulate game money from each of the one or more users at the at least one virtual machine in real time to create a jackpot, wherein the game money is accumulated whenever the one or more users, who share the at least one virtual machine, plays an online game;

a client manager configured to display the jackpot, which is held by the one or more users, who share the at least one virtual machine;

a dividend manager configured to increase a dividend of game money acquirable among the jackpot in the at least one virtual machine by each of the one or more users; and a result sharer configured to distribute the jackpot to other users who share the virtual machine when a specific user in the one or more users wins the jackpot.

2. The jackpot game server of claim 1, wherein, when a first user among the one or more users who share the one virtual machine wins a jackpot, the result sharer is configured to distribute the jackpot equally among other users who share the virtual machine.

3. The jackpot game server of claim 1, wherein the result sharer is further configured to distribute an online game play result of a first user among the one or more users to at least two users who share the virtual machine according to a selection of the first user, and increase a user level of the first user.

4. The jackpot game server of claim 1, wherein the result sharer is further configured to perform gifting that is changeable into game money between the one or more users who share the virtual machine, and increase a user level of a second user among the one or more users who performs the gifting according to a number of gifting times.

5. The jackpot game server of claim 4, wherein the second user is allowed to use more virtual machines according to the user level.

6. The jackpot game server of claim 1, wherein the machine manager is further configured to assign the jackpot, which is accumulated whenever the one or more users who share each of the virtual machines play an online game.

7. The jackpot game server of claim 1, wherein the dividend manager is further configured to allocate the dividend among total jackpot money available with respect to each of the virtual machines according to the number of users who share the virtual machine and a betting ratio of a certain user who shares the virtual machine.

8. The jackpot game server of claim 1, wherein the dividend manager is further configured to distribute an additional dividend to a virtual machine having a larger amount of jackpots accumulated whenever the one or more users play the online game.

9. The jackpot game server of claim 1, wherein the one or more users who share the virtual machine accumulatively accumulates jackpots in real time in the virtual machine.

10. The jackpot game server of claim 1, wherein the client manager is further configured to display at least one profile information of the one or more users, money held by each of the one or more users, and game progress conditions when a request is received from a user of the one or more users.

11. The jackpot game server of claim 1, wherein the jackpot game server is configured to connect to a social network server and select the one or more users by using a social network service or a friend search service provided by the social network server.

12. A jackpot game server configured to provide an online game by simultaneously connecting one virtual machine to one or more users via a network, the jackpot game server comprising:

a machine manager configured to accumulate game money from each of the one or more users at the at least one virtual machine in real time to create a jackpot to be won by the one or more users, wherein the one or more users share the at least one virtual machine;

a dividend manager configured to increase a dividend of the game money acquirable among the jackpot money in the virtual machine by each of the one or more users as a number of users who share virtual machine increases; and a result sharer configured to distribute an online game play result, which is acquired by a first user among the one or more users who share the virtual machine, to other users who share the virtual machine.

13. A machine implemented method for enabling one or more users of an online game to carry out cooperation, wherein the one or more users are simultaneously connected to a virtual machine, the method comprising:

accumulating game money from each virtual machine to create a jackpot to be won by one or more users, wherein the one or more users share the virtual machine;

increasing a dividend of game money acquirable among the jackpot money in the virtual machine by each of the one or more users as a number of users who share virtual machine increases;

distributing an online game play result, which is acquired by a first user among the one or more users who share the one virtual machine, to other users who share the virtual machine, wherein the other users increase a jackpot winning probability by using the distributed online game play result; and equally distributing the won jackpot to the other users who share the one virtual machine when the first user wins the jackpot.

14. The method of claim 13, further comprising displaying the jackpot, which is held by the one or more users, who share the virtual machine.

15. A machine implemented method for performing a jackpot game in a terminal that provides an online game, wherein the terminal includes at least one processor that implements the following steps:

accessing, by the terminal, virtual machine simultaneously used by one or more users through a communication unit via a network;

paying game money whenever an online game provided by the virtual machine is played, and accumulating a portion of the game money as a jackpot;

displaying the accumulated jackpot in real time whenever the online game is played with other users who use the virtual machine;

increasing an acquirable dividend in the accumulated jackpots whenever the online game is played and as a number of other users who use the virtual machine increases; and acquiring the jackpot as game money when a user among the users who use the virtual machine wins a jackpot.

16. The method of claim 15, further comprising distributing an online game play result to other users who share the virtual machine, or receiving an online game play result acquired by a user among the one or more users.

* * * * *